US007143741B2

(12) United States Patent
Yagi

(10) Patent No.: US 7,143,741 B2
(45) Date of Patent: Dec. 5, 2006

(54) TORQUE CONTROLLER FOR INTERNAL COMBUSTION ENGINE

(75) Inventor: Toyoji Yagi, Milton Keynes (GB)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 11/273,553

(22) Filed: Nov. 15, 2005

(65) Prior Publication Data

US 2006/0102143 A1 May 18, 2006

(30) Foreign Application Priority Data

Nov. 15, 2004 (JP) ..... 2004-331116

(51) Int. Cl.
*F02D 43/00* (2006.01)
*F02D 9/00* (2006.01)

(52) U.S. Cl. ..... 123/339.11; 123/399; 123/350

(58) Field of Classification Search ..... 123/339.11, 123/399, 350, 339.22, 339.24
See application file for complete search history.

(56) References Cited

U.S. PATENT DOCUMENTS 5,765,527 A 6/1998 Lehner et al.
6,786,197 B1 * 9/2004 Wild et al. ..... 123/350
6,980,901 B1 * 12/2005 Hartmann et al. ..... 701/101
6,994,653 B1 * 2/2006 Hartmann et al. ..... 477/107
2004/0055561 A1 * 3/2004 Wagner et al. ..... 123/299

* cited by examiner

*Primary Examiner*—Hai Huynh
(74) *Attorney, Agent, or Firm*—Nixon & Vanderhye P.C.

(57) ABSTRACT

A throttle position corresponding to a R—R torque representing a torque in which a reserve torque is added to a required torque at MBT is computed. The throttle position is offset by an amount of a reserve torque in a torque increasing direction. An ignition retard amount for obtaining the required torque is computed based on a ration between the required torque and the R—R torque to cancel an increment in torque due to the offset of the throttle position. Because the offset amount of the ignition timing in the retard direction can be computed without an estimated torque which is determined based on the intake air flow rate including the leak air, it is restricted that the ignition retard amount becomes too large even if the large amount of leak air is generated at the throttle valve.

8 Claims, 8 Drawing Sheets

TORQUE CONTROLLER FOR INTERNAL COMBUSTION ENGINE

CROSS REFERENCE TO RELATED APPLICATIONS

This application is based on Japanese Patent Application No. 2004-331116 filed on Nov. 15, 2004, the disclosure of which is incorporated herein by reference.

FIELD OF THE INVENTION

The present invention relates to a torque controller for an internal combustion engine. The torque controller offsets an intake-air-flow-rate control-value, which is established based on a required torque, in a torque-increasing direction (direction of increasing intake air flow rate) by a reserve torque, and then offsets an ignition timing in a retard direction to cancel an increment of the torque in the intake-air-rate control-value, so that the required torque is obtained.

BACKGROUND OF THE INVENTION

Variation in load of accessories, such as a pump for power steering and a compressor for air conditioner, causes fluctuation in torque of internal combustion engine. In a case that the fluctuation in torque is tried to be restricted by correcting the intake air flow rate, there in a delay in response until the variation in the throttle position (or valve opening degree of idle speed control valve) emerges as a variation in the intake air flow rate, so that the fluctuation in torque (fluctuation in speed of engine) is hardly restricted in a high response by correcting the intake air flow rate.

U.S. Pat. No. 5,765,527 shows a method in which the fluctuation in torque is well restricted by correcting an ignition timing from a view point that a correction of the ignition timing in advance/retard direction emerges as a variation in torque in a high response.

Generally, the ignition timing of the internal combustion engine is adjusted in such a manner as to be close to MBT (Minimum spark advance for Best Torque) in which the torque and fuel economy are in the best conditions. In the case the ignition timing is too closed to the MBT, although the fluctuation in torque is tried to be restricted by compensating a decrement in torque due to the load of the accessories with the increment in torque of the ignition timing, the advance correction of the ignition timing hardly restrict the fluctuation in torque enough.

In the torque control method shown in U.S. Pat. No. 5,765,527, the intake-air-flow-rate control-value is offset in a torque increasing direction by the reserved torque, and this increment in torque is canceled by offsetting the ignition timing in a retard direction so that the required torque is obtained and the increment in torque is reserved to compensate the decrement in torque due to the load of accessory by advance correction of the ignition timing. When the ignition timing is offset in the retard direction, an estimated torque at the MBT is computed based on the intake air flow rate and an engine speed, and then the offset amount of the ignition timing in the retard direction is computed based on a ratio between the required torque and the estimated torque at the MBT.

However, if leak air passing through the throttle valve during idling is increased due to individual differences of the system, an increment of the estimated torque due to the leak air cannot be neglected. Thus, the ratio between the required torque and the estimated torque becomes small to increase the offset amount of the ignition timing in the retard direction, whereby the ignition timing may be retarded too much to deteriorate a fuel economy and to increase a temperature of exhaust gas.

SUMMARY OF THE INVENTION

The present invention is made in view of the foregoing matter and it is an object of the present invention to provide a torque controller for an internal combustion engine, which restricts that the offset amount of the ignition timing in retard direction becomes too large due to a leak air at a throttle valve in order to enhance an accuracy of the torque control, when an intake-air-flow-rate control-value is offset in a torque increasing direction and the increment in torque due to the offset of the intake-air-flow-rate control-value is canceled by offsetting an ignition timing in a retard direction.

According to the present invention, when the intake-air-flow-rate control-value, which is established based on a required torque, is offset in a torque increasing direction by an amount of reserve torque and an increment in torque due to the offset of the intake-air-flow-rate control-value is canceled by offsetting an ignition timing in a retard direction so as to obtain the required torque, the offset amount of ignition timing in the retard direction is computed based on a ratio between the required torque and a torque in which the reserve torque is added on the required torque.

Because the intake-air-flow-rate control-value is determined according to the required torque, the torque in which the reserve torque is added on the required torque is substitute information representing a base-ignition-timing torque in the case that the intake-air-flow-rate control-value is offset by the amount of reserve torque in the torque increasing direction. Thus, a ratio between the required torque and the torque in which the reserve torque is added on the required torque, that is, a ratio between the required torque and the base-ignition-timing torque can derives the offset value of the ignition timing in the retard direction, which is sufficient for canceling the increment in torque due to the offset of the intake-air-flow-rate control-value.

Because the offset amount of the ignition timing in the retard direction can be computed without the estimated torque which is determined based on the intake air flow rate including the leak air, it is restricted that the ignition retard amount becomes too large even if the large amount of leak air is generated at the throttle valve. Thereby, it is restricted that the ignition timing is retarded too much, so that the deterioration of the fuel economy and the increment of the exhaust gas temperature can be restricted.

BRIEF DESCRIPTION OF THE DRAWINGS

The above and other objects, features, and advantages of the present invention will become more apparent from the following detailed description made with reference to the accompanying drawings, in which like parts are designated by like reference number and in which.

DETAILED DESCRIPTION OF THE PREFERRED EMBODIMENTS (First Embodiment)

Figure 1:
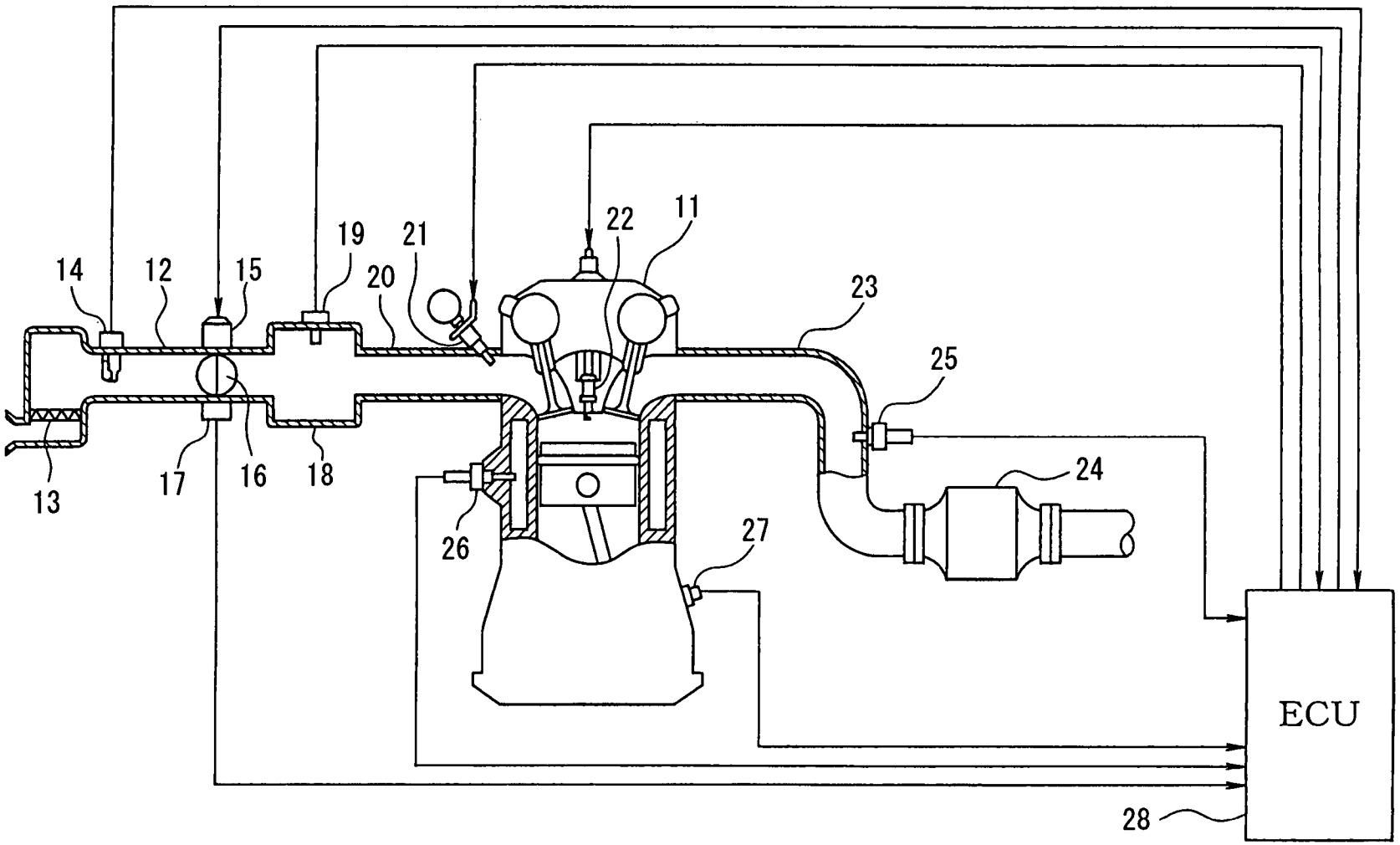
FIG. 1 is a schematically view of an engine control system according to a first embodiment of the present invention.
Figure 2:
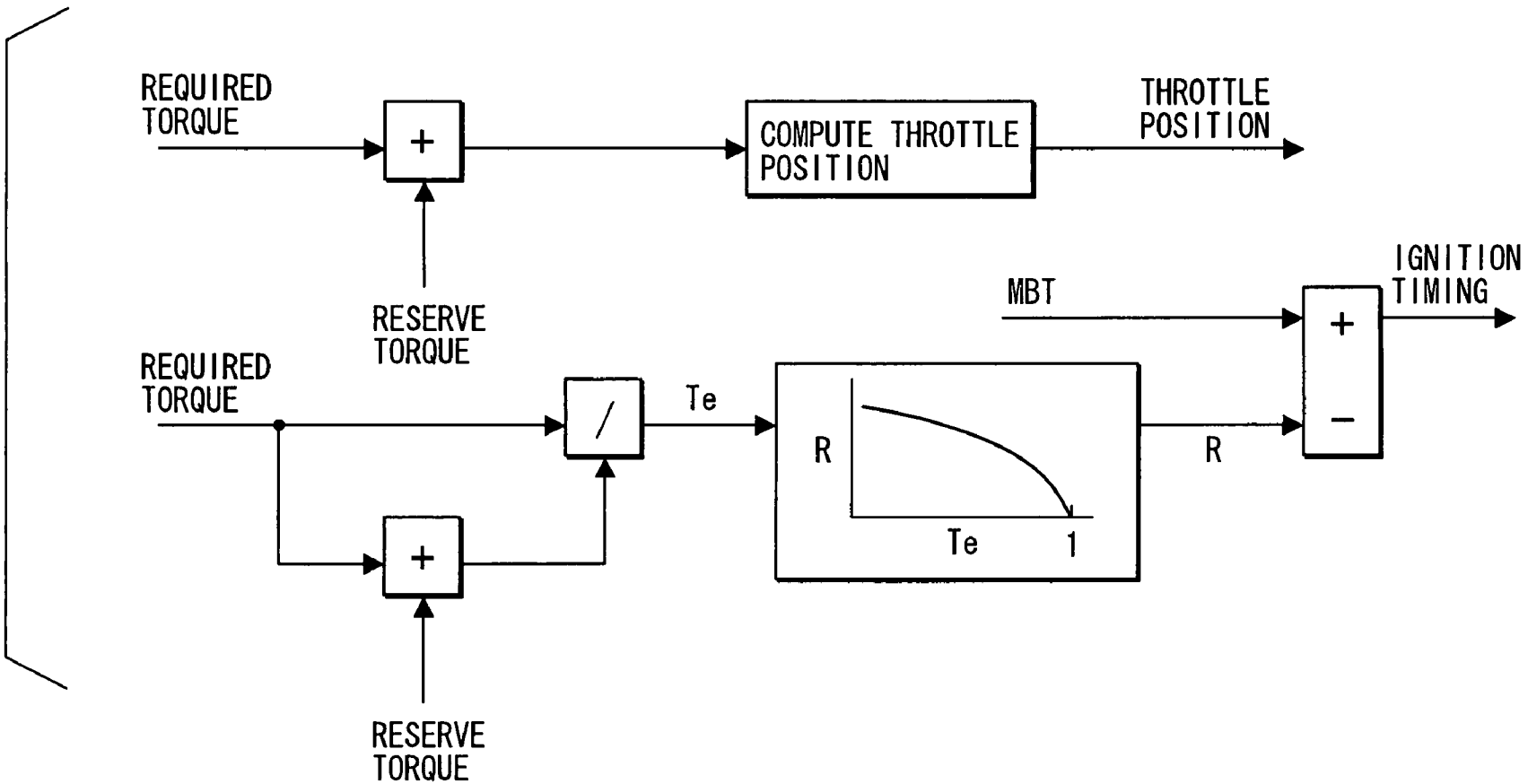
FIG. 2 is a block chart for explaining a torque reserve control according to the first embodiment.

Referring to FIGS. 1 to 3, a structure of an engine control system is described hereinafter. An air cleaner 13 is arranged upstream of an intake pipe 12 of an internal combustion engine 11. An airflow meter 14 detecting an intake air flow rate is provided downstream of the air cleaner 13. A throttle valve 16 driven by a DC-motor 15 and a throttle position sensor 17 detecting a throttle position are provided downstream of the air flow meter 14.

A surge tank 18 including an intake air pressure sensor 19 is provided down steam of the throttle valve 16. The intake air pressure sensor 19 detects intake air pressure. An intake manifold 20 is connected to the surge tank 18. A fuel injector 21 is mounted on the intake manifold 20 at a vicinity of an intake air port. A spark plug 22 is mounted on a cylinder head of the engine 11 corresponding to each cylinder to ignite air-fuel mixture in each cylinder.

An exhaust pipe 23 of the engine 11 is provided with a three-way catalyst 24 purifying CO, HC, and NOx in the exhaust gas. An exhaust gas sensor 25 (an air-fuel ratio sensor, an oxygen sensor) disposed upstream of the three-way catalyst 24 detects air-fuel ratio of the exhaust gas.

A coolant temperature sensor 26 detecting a coolant temperature and a crank angle senor 27 outputting a pulse signal every predetermined crank angle (for example, 30° CA) of a crankshaft of the engine 11 are disposed on a cylinder block of the engine 11. The crank angle and an engine speed are detected based on the output signal of the crank angle sensor 27.

The outputs from the above sensors are inputted into an electronic control unit 28, which is referred to an ECU hereinafter. The ECU 28 includes a microcomputer which executes an engine control program stored in a ROM (Read Only Memory) to control a fuel injection amount based on an engine running condition and an ignition timing.

The ECU 28 performs an idle speed control in which the intake air flow rate is feedback controlled in such a manner that the engine speed becomes consistent with the target idle speed by adjusting a throttle position of the throttle valve 16 with PID control while the engine is idle or an idle speed control condition is established. This process corresponds to an idle speed control means. The idle speed control is referred to as ISC hereinafter.

The ECU 28 performs a torque reserve control in which a position of the throttle valve 16, which is the intake-air-flow-rate control-value, is offset in the torque increasing direction by a preset reserve torque, and then the ignition timing is offset in the retard direction to cancel the increment of torque due to the offset of the throttle position, so that the required torque is obtained. This process corresponds to a torque control means. The torque reserve control establishes the reserve torque by correctly advancing the ignition timing in order to compensate the decrement in torque due to the load of the accessories, such as a pump of power steering apparatus.

Referring to FIG. 2, the torque reserve control is described hereinafter.

A driver-requiring torque is computed based on an accelerator position, an engine speed, and the like. The required torque is computed by adding an increment/decrement in torque due to the ISC and lost torque (internal lost torque, external lost torque) on the deriver-requiring torque. The internal lost torque is as mechanical friction loss, pumping loss, and the like. The external lost torque is a load torque of the accessories (a compressor, an alternator, a pump) driven by the engine 11.

Then, the reserve torque is added on the required torque to obtain a R—R torque. The reserve torque is greater than an absolute value of decrement in torque due to the load of the accessories. The reserve torque can be fixed or varied based on the engine driving condition.

The throttle position is computed based on a map according to the R—R torque. The throttle position is determined as a value corresponding to the R—R torque at a base ignition timing (for example, MBT). Thereby, the throttle position is offset in the torque increasing direction by the reserved torque.

Because the throttle position is determined according to the required torque, the R—R torque is substitute information representing a base-ignition-timing torque in the case that the throttle position is offset by the amount of reserve torque in the torque increasing direction without offsetting the ignition timing in the retard direction. Thus, a ratio between the required torque and the R—R torque, that is, a ratio between the required torque and the base-ignition-timing torque can derives the offset value of the ignition timing in the retard direction, which is sufficient for canceling the increment in torque due to the offset of the throttle position. The offset value of the ignition timing in the retard direction is referred to as an ignition retard amount R.

In the case that the ignition timing is computed, a ratio between the required torque and the R—R torque is computed as a torque efficiency Te. Then, based on a map of the ignition retard amount R, the ignition retard amount R, which is necessary for obtaining the required torque, is computed according to the torque efficiency Te.

In the map of the ignition retard amount R, the ignition retard amount R=0 in the case that the torque efficiency Te=1. According as the torque efficiency Te becomes smaller than 1, the ignition retard amount R is increased.

Then, the ignition timing is computed, which is retarded by the ignition retard amount R from the MBT. The ignition timing is offset by the amount of reserve torque in the retard direction to cancel the increment in torque due to the offset of the throttle position, so that the required torque is obtained.

Figure 4:
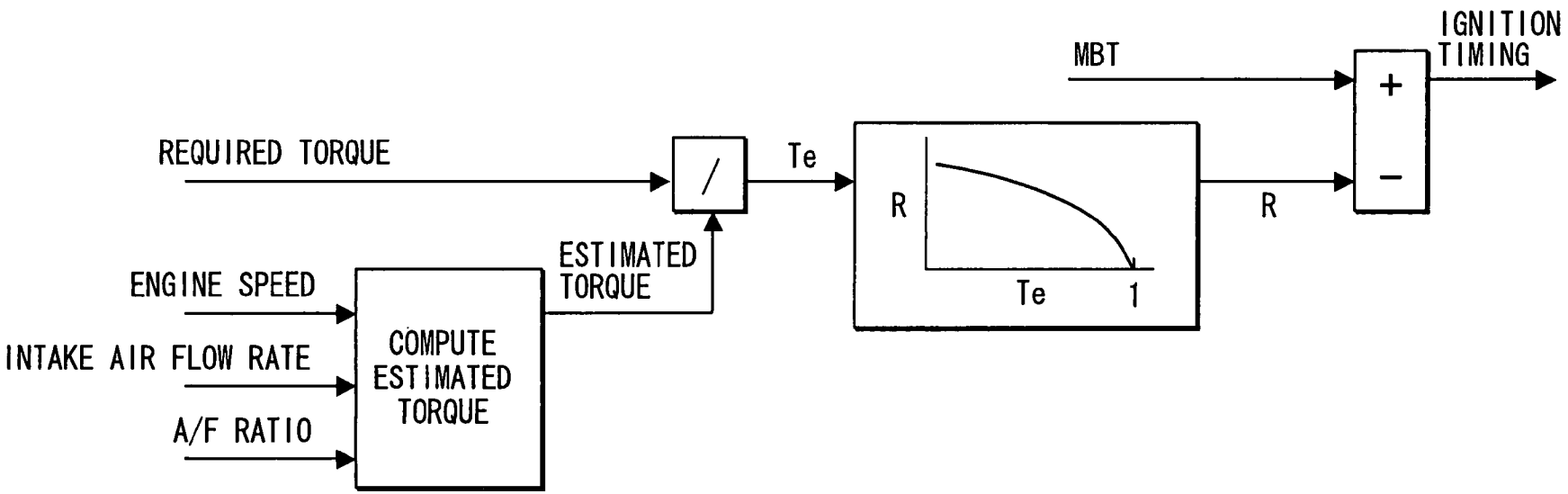
FIG. 4 is a block chart for explaining a torque reserve control according to a comparative example.
Figure 5A:
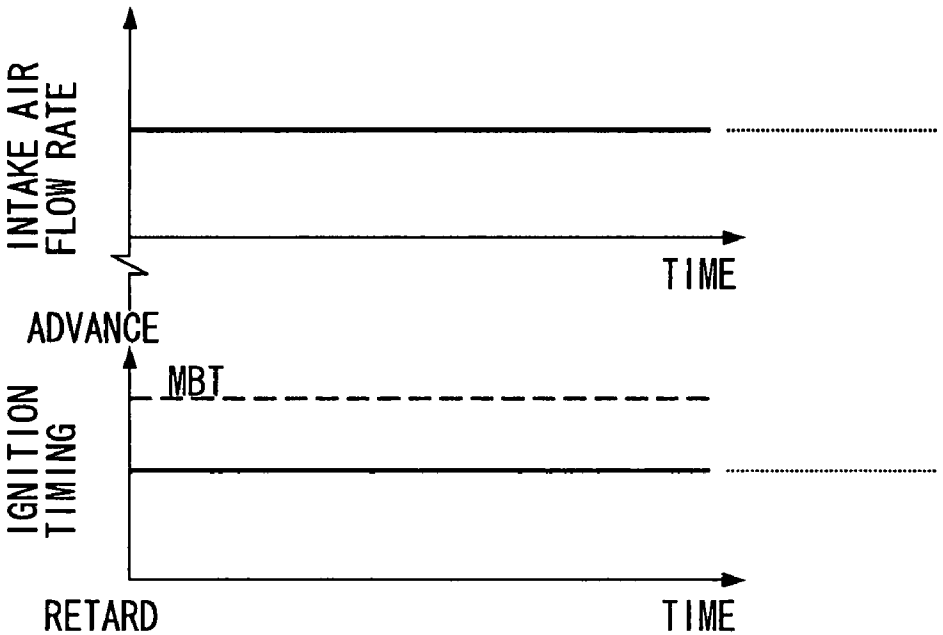
FIGS. 5A and 5B are time charts for explaining the torque reserve control according to the comparative example.
Figure 5B:
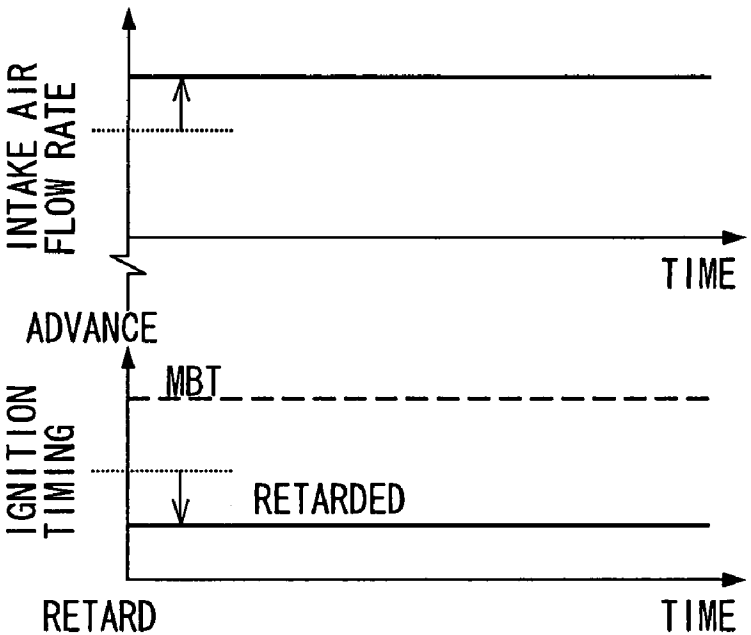

In a comparative example shown in FIG. 4, when the throttle position corresponding to the R—R torque is determined to offset the ignition timing by the amount of reserve torque in the retard direction, the estimated torque at the MBT is computed based on the engine speed, the intake air flow, the air-fuel ratio, and the like, and then the ignition retard amount R is computed based on the ratio (torque efficiency Te) between the required torque and the estimated torque at the MBT. In the situation that a leak air passing through the throttle valve 16 is large amount as shown in FIG. 5B, the increment in the estimated torque due to the leak air cannot be neglected, so that the ratio between the required torque and the estimated torque becomes small to increase the ignition retard amount R. Thereby, there is a possibility that the ignition timing is retarded too much to deteriorate the fuel economy and to increase the temperature of the exhaust gas. FIG. 5A shows the case that a little leak air generated.

Figure 3B:
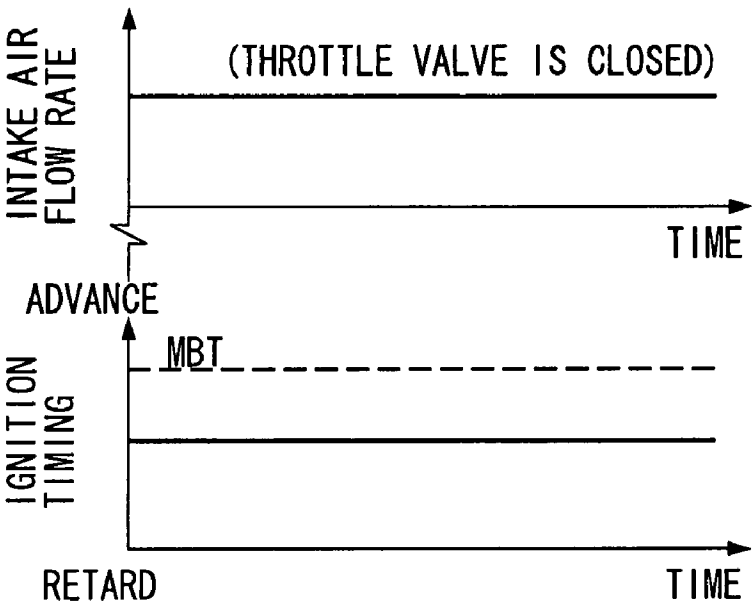
FIGS. 3A and 3B are time chars for explaining a torque reserve control according to the first embodiment.
Figure 3A:
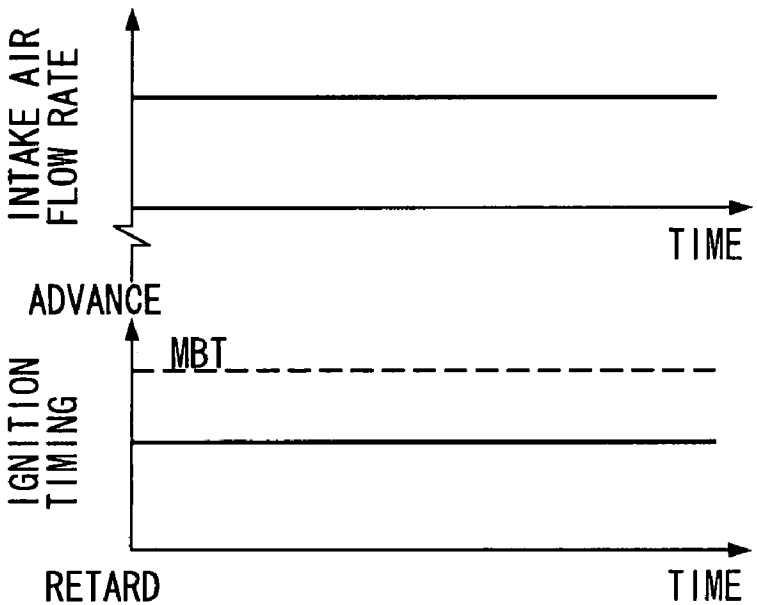

On the contrary, in the torque reserve control shown in FIG. 2 according to the first embodiment, when the throttle position corresponding to R—R torque is determined to offset the ignition timing by the amount of reserve torque in the retard direction, the ignition retard amount R is computed based on the ratio between the required torque and the R—R torque. Because the ignition retard amount R can be computed without the estimated torque which is determined based on the intake air flow rate including the leak air, it is restricted that the ignition retard amount R becomes too large even if the large amount of leak air is generated at the throttle valve 16 as shown in FIG. 3B. FIG. 3A shows the case that a little leak air generated. Thereby, it is restricted that the ignition timing is retarded too much, so that the deterioration of the fuel economy and the increment of the exhaust gas temperature can be restricted.

Furthermore, according to the first embodiment, because the torque reserve control is performed during the ISC, even if the a large amount of leak air is generated during the torque reserve control, the intake air flow rate is reduced, as shown in FIG. 3B, by performing the ISC in which the throttle valve 16 is closed to restrict increment in torque due to the leak air at the throttle valve 16.

(Second Embodiment)

Figure 6:
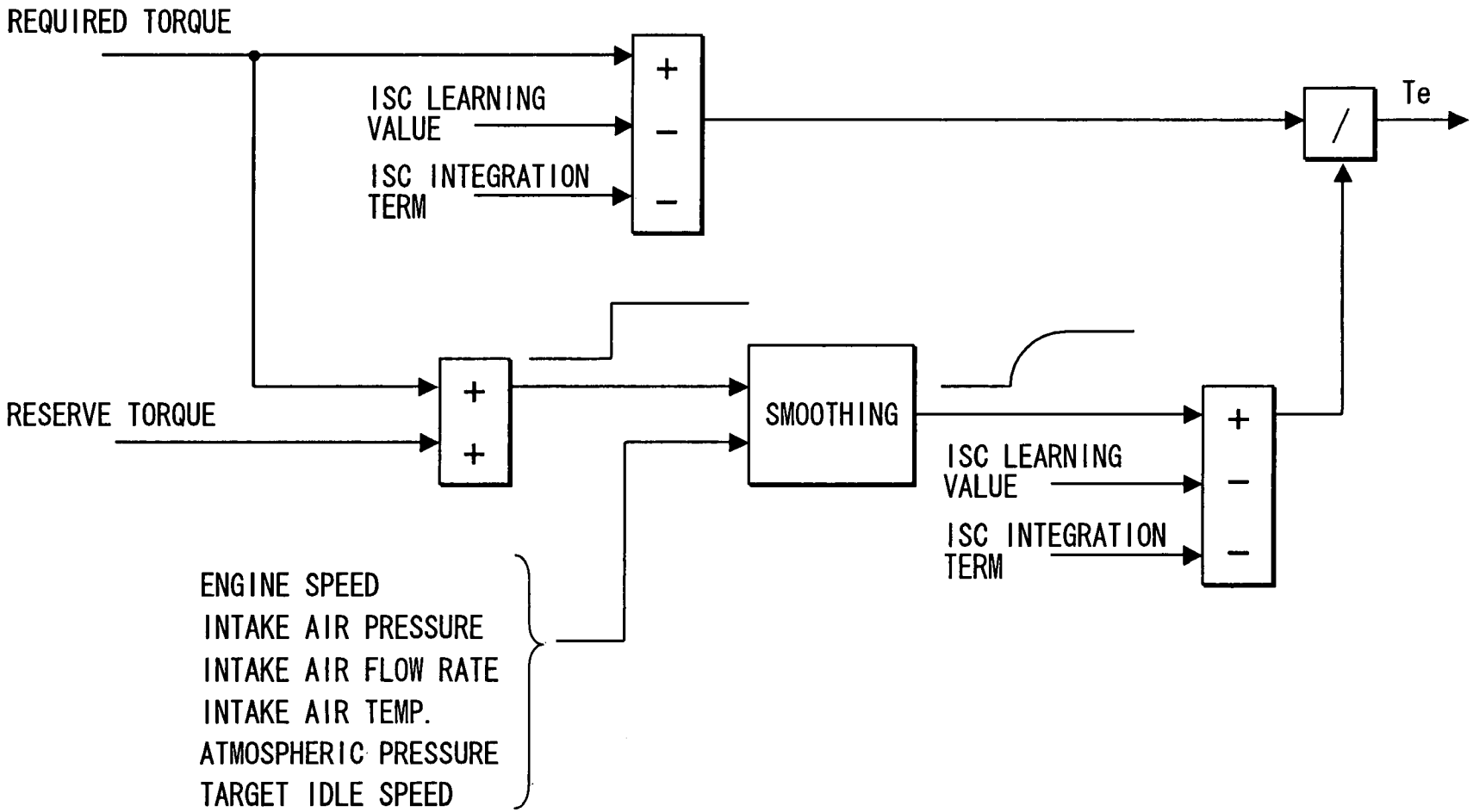
FIG. 6 is a block chart for explaining a torque reserve control according to a second embodiment.
Figure 7:
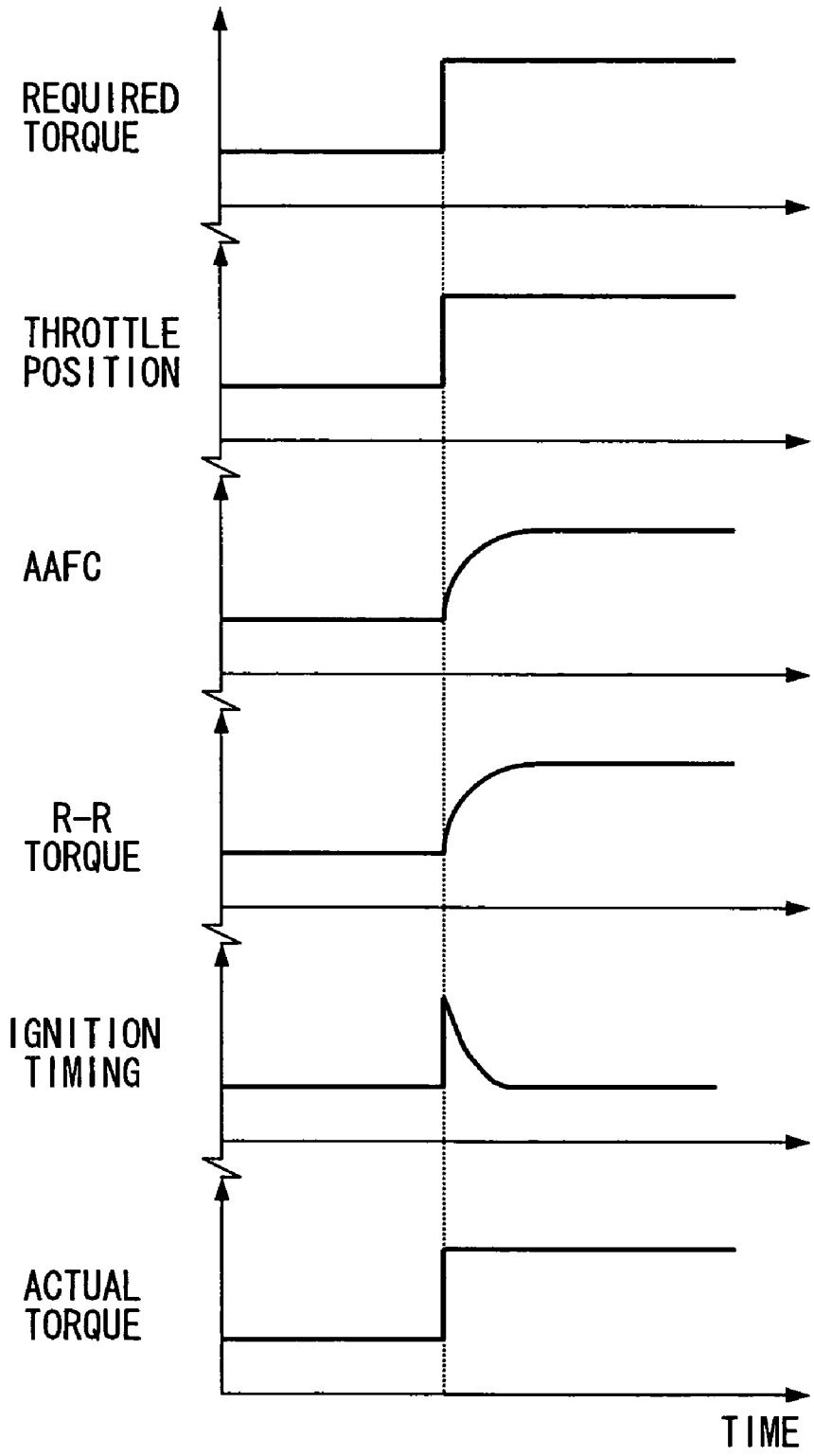
FIG. 7 is a time chart for explaining the torque reserve control according to the second embodiment.

Referring to FIGS. 6 and 7, a second embodiment is described hereinafter.

In a torque reserve control according to the second embodiment, when the ignition retard amount R is computed based on the ratio (torque efficiency Te) between the required torque and the R—R torque, a responsiveness of the R—R torque relative to the required torque is reduced, and effects of an integration term of the feedback correction amount by the ISC, which is referred to as ISC integration term hereinafter, and a learning value of the feedback correction amount by the ISC, which is referred to as ISC learning value hereinafter, are eliminated from the required torque and the R—R torque.

Specifically, when the ignition timing is computed, the effects of the ISC integration term and the ISC learning value are eliminated from the required torque which is computed based on the increment/decrement in torque by the ISC.

Besides, the responsiveness of the R—R torque relative to the required torque is reduced by smoothing (averaging processing, first order lag processing) the R—R torque. Thereby, when the throttle position is varied according to the variation of the required torque, the responsiveness of the R—R torque is reduced with an actual air amount filled in cylinders AAFC as shown in FIG. 7.

A smoothing coefficient for smoothing is determined based on at least one of the engine speed, the intake air pressure, the intake air flow rate, the atmospheric pressure, and the target idle speed, whereby the responsiveness of the R—R torque is varied according to the variation in responsiveness of the actual air amount filled in cylinders AAFC.

As described above, the effects of the ISC integration term and the ISC learning value are eliminated from the smoothed R—R torque.

Then, a ratio between the required torque, from which effects of ISC integration term and the ISC learning value are eliminated, and the smoothed R—R torque is computed as the torque efficiency Te. The ignition retard amount R which is sufficient for obtaining the required torque is computed to offset the ignition timing by the amount of reserve torque in the retard direction.

According to the second embodiment, when the ignition retard amount R is computed based on the ration between the required torque and the R—R torque, the R—R torque is smoothed to reduce the responsiveness of the R—R torque relative to the required torque. Thus, when the throttle position is varied according to the variation of the required torque, the responsiveness of the R—R torque is reduced with an actual air amount filled in cylinders AAFC as shown in FIG. 7. The ignition retard amount R is accurately computed to obtain the required torque even when the required torque is suddenly varied.

According to the second embodiment, the smoothing coefficient for smoothing is determined based on at least one of the engine speed, the intake air pressure, the intake air flow rate, the atmospheric pressure, and the target idle speed, whereby the responsiveness of the R—R torque is varied according to the variation in responsiveness of the actual air amount filled in cylinders AAFC, so that the ignition retard amount R and the ignition timing for obtaining the required torque is accurately computed.

When the ignition retard amount R is computed based on the ratio between the required torque and the R—R torque, the effects of the ISC integration term and the ISC learning value are eliminated from the required torque and the R—R torque. Thus, it is restricted that the ratio between the required torque and the R—R torque is varied to deviate the ignition timing.

Because the ISC integration term and the ISC learning value vary slowly, the smoothing of the ISC integration term and the ISC learning value may cause an over retard of the ignition timing to deteriorate the fuel economy. According to the second embodiment, when the ISC integration term and the ISC learning value are eliminated from the required torque and the R—R torque, the smoothing of the ISC integration term and the ISC learning value is not conducted. Thus, it is restricted that the over retard of the ignition timing causes the deterioration of the fuel economy.

(Third Embodiment)

Generally, in a catalyst quick warm-up control, the ignition timing is retarded in order to increase the exhaust gas temperature. In the situation that the normal torque reserve control is performed during the catalyst quick warm-up control, the ignition timing may be suddenly changed and the combustion may become unstable.

Figure 8:
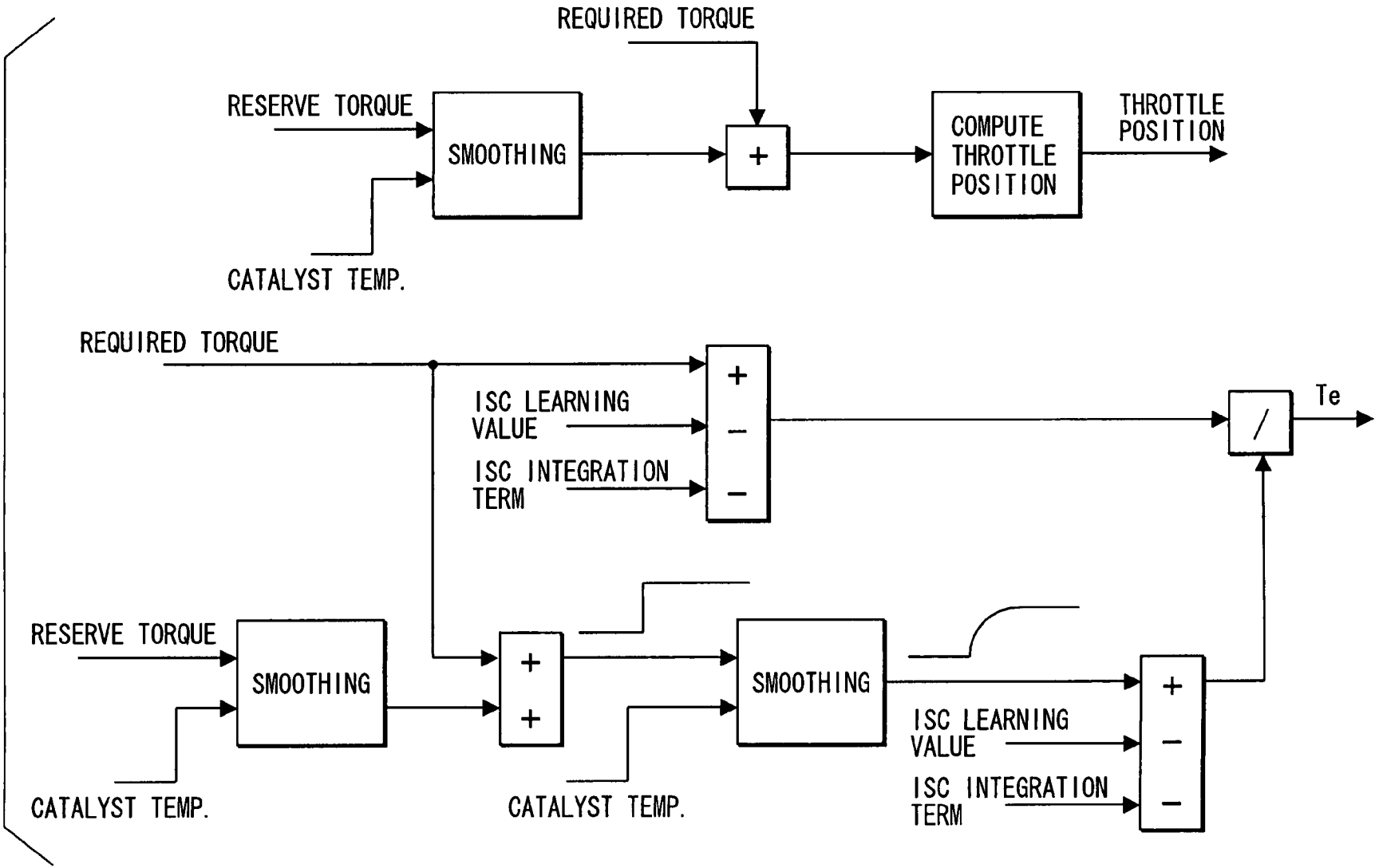
FIG. 8 is a block chart for explaining a torque reserve control according to a third embodiment.

According to a third embodiment shown in FIG. 8, when the torque reserve control is performed during the catalyst quick warm-up control, the responsiveness of the reserve torque and the R—R torque are reduced.

Specifically, the reserve torque for computing the throttle position and the reserve torque for computing the ignition retard amount are smoothed. According as an estimated catalyst temperature, which is estimated based on the engine coolant temperature, decreases, the responsiveness of the reserve torque is more reduced. Alternatively, when the estimated catalyst temperature is lower than a catalyst warm-up completed temperature, the reserve torque is smoothed. When the estimated catalyst temperature is higher then the catalyst warm-up completed temperature, the reserve torque is not smoothed. Thereby, when the torque reserve control is performed during the catalyst quick warm-up control, the responsiveness of the reserve torque is more reduced than that in the normal torque reserve control.

When the ignition retard amount is computed, the R—R torque is smoothed so that the responsiveness of the R—R torque relative to the required torque is reduced. According as the estimated catalyst temperature decreases, the responsiveness of the R—R torque is more reduced. Alternatively, when the estimated catalyst temperature is lower than the catalyst warm-up completed temperature, the responsiveness of the R—R torque is reduced. Thereby, when the torque reserve control is performed during the catalyst quick warm-up control, the responsiveness of the R—R torque is more reduced than that in the normal torque reserve control.

According to the third embodiment, when the torque reserve control is performed during the catalyst quick warm-up control, the responsiveness of the reserve torque and the R—R torque are reduced, so that fluctuation of the ignition timing is restricted and the combustion becomes stable.

In the torque reserve control according to the first to third embodiment, when the throttle position corresponding to the R—R torque is determined to offset the ignition timing by the amount of the reserve torque in the retard direction torque, the ignition retard amount R is computed based on the ratio between the required torque and the R—R torque. When a torque-down requirement is generated from a traction control system or an anti-lock braking system during the torque reserve control, the estimated torque at the MBT is computed based on the engine speed, the intake air flow rate, the air-fuel ratio and the like, and then the ignition retard amount R may be computed based on the ratio between the required torque and the estimate torque which is computed based on the actual engine driving condition. Thus, the ignition retard amount R for obtaining the required torque is accurately computed so that the torque control, which accurately corresponds to the torque down requirement, can be performed.

In the first to third embodiments, the torque reserve control is performed during the ISC. The torque reserve control can be performed while the ISC is not performed.

An ISC control valve may be provided in a bypass passage, which bypasses the throttle valve 16, in order to perform the ISC.

What is claimed is:

1. A torque controller for an internal combustion engine, comprising:

a torque control means for performing a torque reserve control in which an intake-air-flow-rate control-value determined based on a required torque is offset by an amount of a predetermined reserve torque in a torque increasing direction, and an ignition timing is offset in a retard direction to cancel an increment in torque due to an offset of the intake-air-flow-rate control-value, whereby the required torque is obtained, wherein the torque control means computes an offset amount of the ignition timing in a retard direction based on a ratio between the required torque and a R—R torque representing a torque in which the reserve torque is added on the required torque.

2. The torque controller according to claim 1, wherein the torque control means reduces a responsiveness of the R—R torque or the reserve torque when computes the offset amount of the ignition timing.

3. The torque controller according to claim 2, wherein the torque control means determines the responsiveness of the R—R torque relative to the required torque during the torque reserve control based on at least one of an engine speed, an intake air pressure, an intake air flow, an intake air temperature, and an target idle speed.

4. The torque controller according to claim 1, further comprising:

an idle speed control means for feedback controlling an intake-air-flow controlling means in such a manner that an idle speed of the internal combustion engine is brought to be consistent with an target idle speed in a situation that an idle speed control condition is established, wherein the torque control means performs the torque reserve control during an idle speed control by the idle speed control means.

5. The torque controller according to claim 4, wherein the torque control means eliminates effects of an integral term and a learning value of a feedback correction amount by the idle speed control means from the required torque and the R—R torque respectively when computes the offset amount of the ignition timing.

6. The torque controller according to claim 4, wherein the torque control means eliminates effects of the integral term and the learning value without reducing a responsiveness relating to the integral term and the learning value.

7. The torque controller according to claim 1, wherein the torque control means computes the offset amount of the ignition timing in the retard direction based on a ratio between the required torque and an estimated torque which is computed based on a driving condition of the internal combustion engine when a torque down requirement is generated during the torque reserve control.

8. The torque controller according to claim 1, wherein the torque control means varies a responsiveness of the R—R torque and/or the reserve torque in the case that the torque reserve controls is performed during a catalyst quick warm-up control.

* * * * *